US006100849A

United States Patent [19]

Tsubaki et al.

[11] Patent Number: 6,100,849

[45] Date of Patent: Aug. 8, 2000

[54] SURFACE MOUNT ANTENNA AND COMMUNICATION APPARATUS USING THE SAME

[75] Inventors: Nobuhito Tsubaki; Kazunari Kawahata, both of Kyoto, Japan

[73] Assignee: Murata Manufacturing Co., Ltd., Japan

[21] Appl. No.: 09/219,547

[22] Filed: Dec. 22, 1998

[30] Foreign Application Priority Data

Nov. 17, 1998 [JP] Japan ..... 10-326695

[51] Int. Cl.[7] ..... H01Q 1/24; H01Q 1/30

[52] U.S. Cl. ..... 343/702; 343/700 MS

[58] Field of Search ..... 343/700 MS, 702; H01Q 1/38, 1/24

[56] References Cited

U.S. PATENT DOCUMENTS 5,912,647 6/1999 Tsuru et al. ..... 343/700 MS 5,926,139 7/1999 Korisch ..... 343/700 MS

*Primary Examiner*—Michael C. Wimer

*Attorney, Agent, or Firm*—Ostrolenk, Faber, Gerb & Soffen, LLP

[57] ABSTRACT

A surface mount antenna, comprising: a base, comprising an insulator having a first main face, a second main face and end faces extending between said first main face and second main face, a ground electrode provided on the first main face of said base, first and second radiation electrodes, provided on the second main face of said base, and a first connection electrode, a second connection electrode and a feed electrode, provided on end faces of said base, said first and second radiation electrodes facing each other with a slit in between, said slit being provided at a diagonal to all sides of the second main face of said base, the slit having first and second ends extending to end portions of the second main face, an end of said first radiation electrode which is near to the first end of said slit connecting to said ground electrode via said first connection electrode, said feed electrode being provided near to an end portion of the first radiation electrode, with a gap provided between the feed electrode and the first radiation electrode, said end portion being distant from another end portion of said first radiation electrode where said first connection electrode is connected, and an end portion of said second radiation electrode, which is a fixed distance from the first end of said slit, connected to said ground electrode via said second connection electrode.

8 Claims, 7 Drawing Sheets

SURFACE MOUNT ANTENNA AND COMMUNICATION APPARATUS USING THE SAME

BACKGROUND OF THE INVENTION

1. Field of the Invention

The present invention relates to a surface mount antenna and a communication apparatus using the same, more particularly to a surface mount antenna used in a mobile telephone and a communication apparatus using the same.

2. Description of the Related Art

Conventionally, a whip antenna, capable of obtaining a wide pass band for covering both transmitting frequency and receiving frequency bands, has principally been used as the main antenna of a mobile telephone. However, since a whip antenna protrudes from the case of the mobile telephone, it is bulky and liable to break, and progress in development of small-scale and lightweight mobile telephones has brought a need for a small-scale antenna covering a wide pass band and which is not bulky.

FIG. 9 shows a conventional antenna aimed at obtaining a wide pass band. In FIG. 9, an antenna 1 comprises several electrodes provided on faces of a rectangular box-shaped base 2, which is an insulator comprising a dielectric such as ceramic or resin. Firstly, a ground electrode 3 is provided almost entirely over a first main face of the base 2. Furthermore, a first radiation electrode 4 and a second radiation electrode 5 are provided in parallel, with a gap g1 in between them, on a second main face of the base 2. Furthermore, one end of the first radiation electrode 4 forms an open terminal, and the other end crosses over (extends) to the first main face via one of the end faces of the base 2 and connects to the ground electrode 3. Furthermore, one end of the second radiation electrode 5 forms an open terminal and the other end crosses over (extends) to the first main face, via the same end face of the base 2 as in the case of the first radiation electrode 4 and connects to the ground electrode 3. Then, a feed electrode 6 is provided in another end face, opposite to the end face of the base 2 which the end faces of both the first radiation electrode 4 and the second radiation electrode 5 cross over (extend) to, and one part of the feed electrode 6 crosses over (extends) to the first main face of the base 2.

In the antenna 1 of such a constitution, when a signal is transmitted to the feed electrode 6, capacitance between one end of the first radiation electrode 4 and the second radiation electrode 5 and the feed electrode 6 transmits the signal to the first radiation electrode 4 and the second radiation electrode 5. Then, since one end of the first radiation electrode 4 and the second radiation electrode 5 becomes an open terminal and the other end becomes a connection terminal, the electrodes 4 and 5 are resonant at a frequency where the length from the one end to the other end is a quarter of the effective wavelength. Now, the pass band of the antenna 1 can be made wide by differing the resonant frequencies of the first radiation electrode 4 and the second radiation electrode 5 so that their pass bands overlap slightly.

However, in the antenna 1 shown in FIG. 9, the gap g1 is narrow in order to ensure that vectors of the resonant currents flowing through the first radiation electrode 4 and the second radiation electrode 5 are parallel, but when the resonant frequencies of the first radiation electrode 4 and the second radiation electrode 5 differ considerably, only one of the radiation electrodes is resonant and the other radiation electrode is not resonant, making it difficult to achieve a stable double resonance. Furthermore, when the antenna 1 is made small-scale by reducing the gap g1, the two radiation electrodes are moved closer to each other, whereby current flows through the two radiation electrodes in reverse phase, causing further deterioration of antenna characteristics.

SUMMARY OF THE INVENTION

It is an object of a preferred embodiment of the present invention to solve the above problems by providing a surface mount antenna, which is small-scale and has a wide pass band, and a communication apparatus using the same.

The preferred embodiment of the present invention comprises:

a surface mount antenna, comprising: a base, comprising a roughly trapezoid insulator having a first main face, a second main face and end faces extending between the first main face and second main face; a ground electrode, mainly provided on the first main face of the base; first and second radiation electrodes, mainly provided on the second main face of the base; and a first connection electrode, a second connection electrode and a feed electrode, provided on end faces of the base; the first and second radiation electrodes facing each other with a slit in between, the slit being provided at a diagonal to all sides of the second main face of the base; an end of the first radiation electrode which is near to an end of the slit connecting to the ground electrode via the first connection electrode; the feed electrode being provided near to an end portion, with a gap in between, which is distant from an end portion of the first radiation electrode where the first connection electrode is connected; and an end portion of the second radiation electrode, which is a fixed distance from an end of the slit, connected to the ground electrode via the second connection electrode.

By the above constitution, the surface mount antenna can be made small-scale and its pass band can be widened.

Furthermore, a preferred embodiment of the present invention comprises: a surface mount antenna, comprising a base, comprising a roughly trapezoid insulator having a first main face, a second main face and end faces extending between the first main face and second main face; a ground electrode, mainly provided on the first main face of the base; first and second radiation electrodes, mainly provided on the second main face of the base; and a first connection electrode, a second connection electrode and a feed electrode, provided on end faces of the base; the first and second radiation electrodes facing each other with a slit in between, the slit being provided at a diagonal to all sides of the second main face of the base; an end of the first radiation electrode which is near to an end of the slit connecting to the ground electrode via the first connection electrode; the feed electrode being connected in the vicinity of an end portion of the first radiation electrode where the first connection electrode is connected; and an end portion of the second radiation electrode, which is a fixed distance from an end of the slit, connected to the ground electrode via the second connection electrode.

The above constitution also enables the surface mount antenna to be made small-scale with a wider pass band. According to such a constitution, double resonance is more likely to occur, and the pass band of the surface mount antenna can be easily widened.

Furthermore, a preferred embodiment of the present invention provides a communication apparatus comprising the above surface mount antenna. By using the surface mount antenna of the present invention, the communication apparatus does not require a whip antenna, and can be made small-scale with cost reduction.

Other characteristics and effects of the present invention will more fully appear from the following detailed description, when the same is read in conjunction with the accompanying drawings.

DESCRIPTION OF THE PREFERRED EMBODIMENTS

Figure 1:
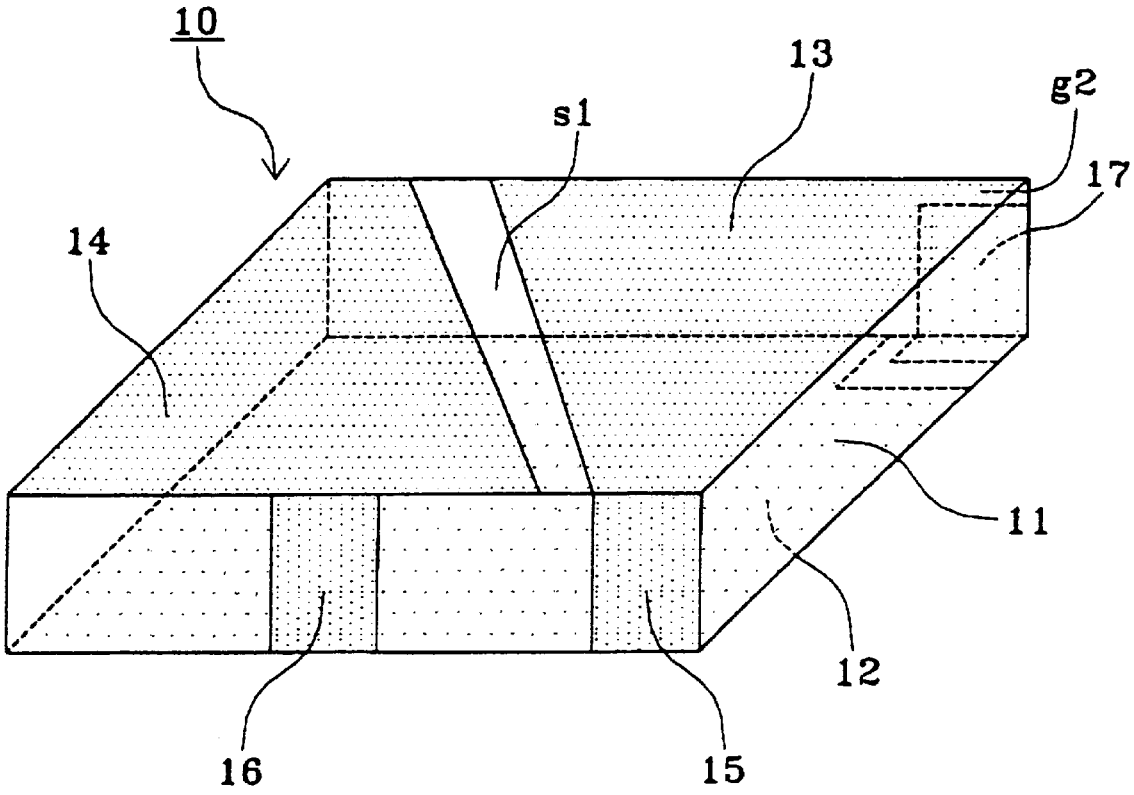
FIG. 1 is a see-through perspective view of an embodiment of a surface mount antenna of the present invention.

FIG. 1 shows an embodiment of a surface mount antenna of the present invention. In FIG. 1, a surface mount antenna 10 comprises several electrodes provided on faces of a rectangular box-shaped base 11, being an insulator comprising a dielectric, such as ceramic or resin. Firstly, a ground electrode 12 is provided on a first main face of the base 11, and a first radiation electrode 13 and a second radiation electrode 14 are provided facing each other, with a slit s1 in between, on a second main face of the base 11. Here, the slit s1 is narrower at one end than at its other end, and is, moreover, diagonal to every side of the second main face of the base 11, and consequently the first radiation electrode 13 and the second radiation electrode 14 are both trapezoid in shape, having a long side and a short side, which are parallel to each other, a perpendicular side, and an inclined side. Furthermore, the end portion of the first radiation electrode 13 near to one end of the slit s1, that is, the end portion at the short side of the trapezoid, is connected via a connection electrode 15, provided on the end face of the base 11, to the ground electrode 12 and thereby to ground. Then, a feed electrode 17 is provided on an end face of the base 11, being the end portion of the first radiation electrode 13 which is considerably distant from the end portion where the first connection electrode 15 is connected, that is, the end portion which forms part of the long side of the trapezoid, with a gap g2 provided in between. Here, although part of the feed electrode 17 crosses over (extends) to the first main face of the base 11, it is insulated from the ground electrode 12. In addition, the end portion of the second radiation electrode 14 which is at a fixed distance from one end of the slit s1, that is, part of the long side of the trapezoid, is connected through a second connection electrode 16, provided on the end face of the base 11, to the ground electrode 12 and thereby to ground.

Figure 2:
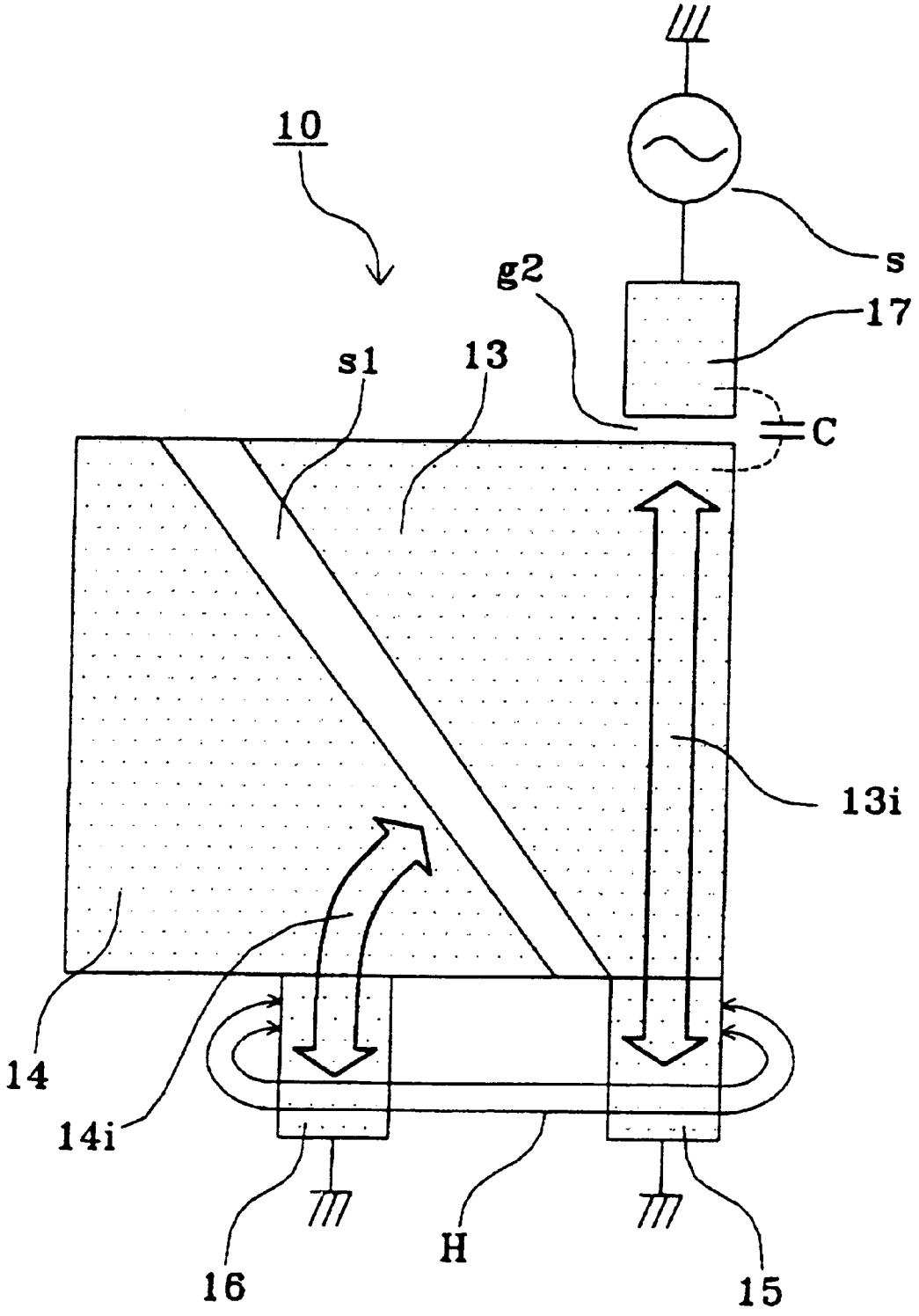
FIG. 2 is a plan view of the surface mount antenna of FIG. 1.

FIG. 2 shows a plan view of the surface mount antenna 10 of such a constitution, which will be used to explain the operation of the surface mount antenna 10. In FIG. 2, the electrodes provided on the end face of the base 11 are opened out to as to simplify understanding of the state of the first connection electrode 15, the second connection electrode 16 and the feed electrode 17.

In FIG. 2, a signal source s is connected to the feed electrode 17 and inputs a signal to the feed electrode 17. A signal input to the feed electrode 17 is transmitted to the first radiation electrode 13 through the capacitance C, formed between the feed electrode 17 and the first radiation electrode 13. In the first radiation electrode 13, the long side portion of the trapezoid becomes an open terminal, and the short side portion is connected to ground by the connection electrode 15, and consequently the first radiation electrode 13 resonates at a frequency where the length between the long side and the short side is a quarter of the effective wavelength. At this time, when the resonant current 13*i* of the first radiation electrode 13 is averaged, the result is a line joining the long side and the short side of the first radiation electrode 13.

On the other hand, in the second radiation electrode 14, since part of the end portion is connected to ground by the connection electrode 16, this part becomes a ground terminal, and there is a possibility of resonance at a frequency where the length from this ground terminal to the end which forms another open terminal is a quarter of the wavelength.

Generally, in a radiating conductor wherein the end which resonates at a quarter wavelength is the open terminal and the other end is the ground terminal, the generated magnetic field is at its smallest near the open terminal, and strongest near the ground terminal. As a result, the magnetic field generated in the first radiation electrode 13 is stronger near the connection electrode 15. Furthermore, the magnetic field generated in the second radiation electrode 14 is stronger near the connection electrode 16, which becomes a ground terminal during resonating. Then, since the first connection electrode 15 is provided near one end of the slit s1, and the second connection electrode 16 is provided at a fixed distance from this end of the slit s1, the two electrodes are relatively close together, and are parallel to each other. As a consequence, the first connection electrode 15 and the second connection electrode 16 become magnetically coupled. In FIG. 2, H represents the magnetic field which couples the first connection electrode 15 and the second connection electrode 16.

In this way, since the first connection electrode 15 and the second connection electrode 16 are coupled by a magnetic field, the signal from the first radiation electrode 13 is transmitted through the magnetic field coupling to the second radiation electrode 14, whereby the second radiation electrode 14 resonates. Furthermore, in the second radiation electrode 14, since the slit s1 is provided diagonal to every side of the second main face of the base 11, and the second radiation electrode 14 is capacitance-coupled to the first radiation electrode 13 which it faces over the slit s1, the second radiation electrode 14 resonates with the inclined side as an open terminal and part of the long side as a ground terminal. As a result, in the second radiation electrode 14, when the resonant current 14*i* is averaged, it curves in a direction from part of the long side to a roughly central portion of the inclined side, that is, toward the first radiation electrode 13.

As a result, while the first radiation electrode 13 and the second radiation electrode 14 are resonating, the direction of the resonant current 13*i* in the first radiation electrode 13 and the direction of the resonant current 14*i* in the second radiation electrode 14 intersect each other approximately at a right angle. Therefore, since the vectors of the electric field and magnetic field near the first radiation electrode 13 and the second radiation electrode 14 likewise intersect each other approximately at a right angle, mutual interference is unlikely to occur, making it possible to easily obtain stable double resonance.

Furthermore, in the surface mount antenna 10 of this type of constitution, by differing the resonant frequencies of the first radiation electrode 13 and the second radiation electrode 14 so that they slightly overlap, reduction of gain and the like due to relative interference can be eliminated, and a wide pass band can be obtained. Then, since the pass band is wide, there is no need to switch the resonant frequency of a single antenna, and therefore no frequency switching circuit is required, enabling the space required to be reduced, whereby the surface mount antenna 10 can be made small-scale and costs can be reduced. Furthermore, since the first radiation electrode 13 and the second radiation electrode 14 are provided on a dielectric base 11, the wavelength contraction effect of the dielectric enables the length of the radiation electrodes to be reduced, and as a consequence, the surface mount antenna 10 can be made still smaller.

Furthermore, it is possible to form surface mount antennas of various sizes and covering various frequencies, by varying the permittivity of the substrate. In addition, since it is possible to form a surface mount antenna comprising a single rectangular box-shaped base capable of double resonance, there is an advantage of enabling manufacturing costs to be reduced when providing the surface mount antenna on a mount substrate; for instance, the antenna can be handled easily and can be automatically mounted on the mount substrate.

Figure 3:
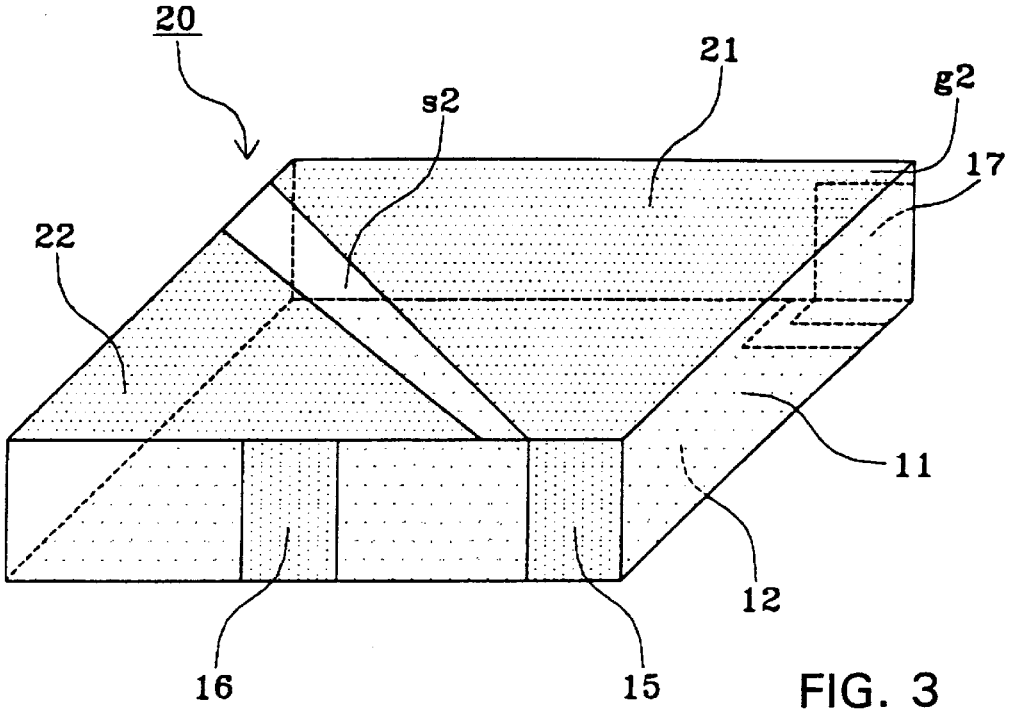
FIG. 3 is a see-through perspective view of another embodiment of a surface mount antenna of the present invention.

FIG. 3 shows another embodiment of the surface mount antenna of the present invention. In FIG. 3, like reference numerals are used for like members of FIG. 1, and explanation thereof is omitted.

In the surface mount antenna 20 shown in FIG. 3, a first radiation electrode 21 and a second radiation electrode 22 are provided on the second main face of the base 11, facing each other with a slit s2 in between. Here, the width of one end of the slit s2 is narrower than the width of the other end, and moreover, the slit s2 is provided at a diagonal to every side of the second main face of the base 11, between two adjacent sides, so that the first radiation electrode 21 is pentagonal, having a long side and a short side which are parallel, a long side and short side perpendicular to these, and an inclined side; and the second radiation electrode 22 is triangular, having a low side, a perpendicular side and an inclined side.

In the surface mount antenna 20 of this constitution, the shapes of the first and second radiation electrodes differ from those of the surface mount antenna 10 shown in FIG. 1, while operating in substantially the same manner and achieving the same effects.

Figure 4:
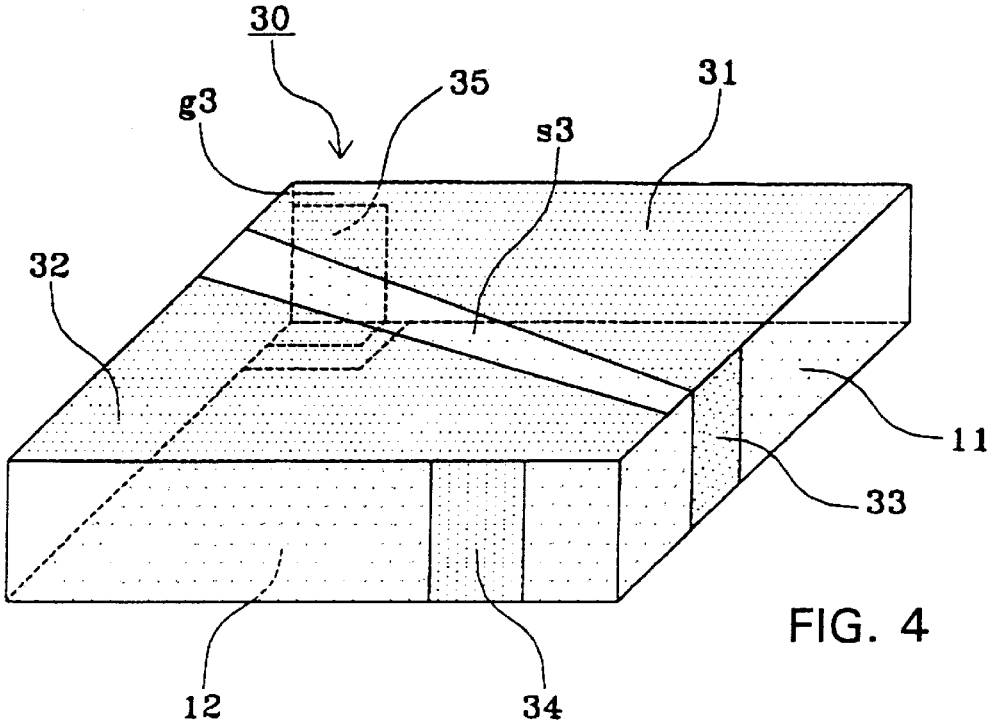
FIG. 4 is a see-through perspective view of yet another embodiment of a surface mount antenna of the present invention.

FIG. 4 shows yet another embodiment of the surface mount antenna of the present invention. In FIG. 4, like reference numerals are used for like members of FIG. 1, and explanation thereof will be omitted.

In the surface mount antenna 30 shown in FIG. 4, a first radiation electrode 31 and a second radiation electrode 32 are provided on the second main face of the base 11, facing each other with a slit s3 in between. Here, the width of one end of the slit s3 is narrower than the width of the other end, and moreover, the slit s3 is provided diagonal to every side of the second main face of the base 11, so that the first radiation electrode 31 and the second radiation electrode 32 are both trapezoid in shape, having parallel long and short sides, a side perpendicular thereto, and an inclined side. Furthermore, the end portion of the first radiation electrode 31 which is near to one end of the slit s3, that is, the end portion at the end of the long side of the trapezoid, is connected by a first connection electrode 33 to a ground electrode 12, and thereby to ground. Furthermore, a feed electrode 35 is provided at an end portion of the base 11, being the end portion of the first radiation electrode 31 which is considerably distant from the end portion where the first connection electrode 33 is connected, that is, the end portion at the end of the long side of the trapezoid, with a gap g3 provided in between. Here, although part of the feed electrode 35 crosses over (extends) to the first main face of the base 11, it is insulated from the ground electrode 12. In addition, the end portion of the second radiation electrode 32 which is at a fixed distance from one end of the slit s3, that is, part of the long side of the trapezoid, is connected through a second connection electrode 34, provided on the end face of the base 11, to the ground electrode 12 and thereby to ground. Therefore, the first connection electrode 33 and the second connection electrode 34 are provided on separate and adjacent end faces of the base 11.

Thus, although the first connection electrode 33 and the second connection electrode 34 are provided on separate and adjacent end faces of the base 11, they are comparatively close to each other, while being three-dimensionally parallel, and consequently are coupled together by a magnetic field. Therefore, in the surface mount antenna 30, signals from the first radiation electrode 31 can be transmitted through the magnetic coupling to the second radiation electrode 32, double resonance can be achieved, and the surface mount antenna can be used over a wide pass band in the same manner as in the surface mount antenna 10. In addition, the antenna can be made small-scale and cost can be lowered, as with the surface mount antenna 10.

Figure 5:
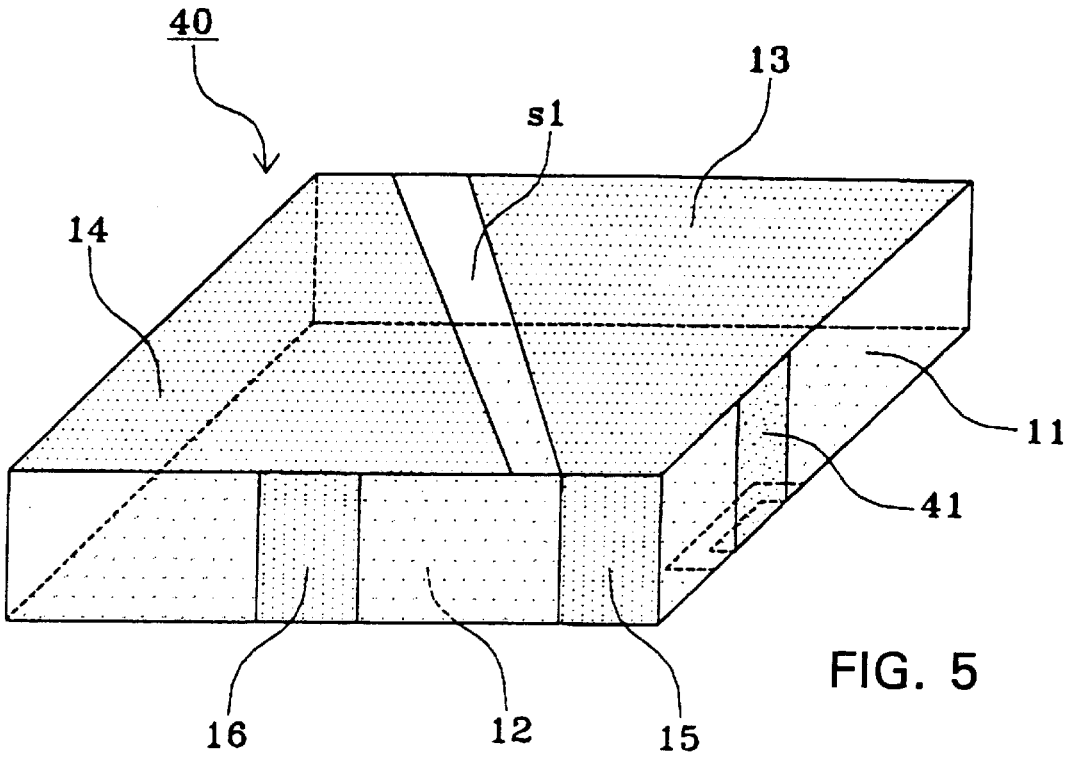
FIG. 5 is a see-through perspective view of yet another embodiment of a surface mount antenna of the present invention.

FIG. 5 shows yet another embodiment of the surface mount antenna of the present invention. In FIG. 5, like reference numerals are used for like members of FIG. 1, and explanation thereof will be omitted.

In the surface mount antenna 40 shown in FIG. 5, a feed electrode 41 is connected at an end face of the base 11, close to the end portion where the first connection electrode 15 of the first radiation electrode 13 is connected, that is, it is connected along part of the perpendicular side which is near to the short side. Although part of the feed electrode 41 crosses over (extends) to the first main face of the base 11, it is insulated from the ground electrode 12.

In the surface mount antenna 40 of this constitution, the first radiation electrode 13 is resonated by inputting signals from the feed electrode 41 directly to the first radiation electrode 13. That is, the first radiation electrode 13 in its entirety forms a reverse F antenna.

Even though the first radiation electrode 13 comprises a reverse F antenna, in view of the face that the antenna resonates at a frequency where the length between the long side and the short side is a quarter of the effective wavelength, this is roughly the same as the surface mount antenna 10 shown in FIG. 1. Therefore, in the surface mount antenna 40, signals from the first radiation electrode 13 can be transmitted by magnetic coupling to the second radiation electrode 14, double resonance can be achieved, and the surface mount antenna can be used over a wide pass band in the same manner as in the surface mount antenna 10. In addition, the antenna can be made small-scale and cost can be lowered, as with the surface mount antenna 10.

Here, in the surface mount antenna 40, the first radiation electrode 13 of the surface mount antenna 10 shown in FIG. 1 was a reverse F antenna, but the first radiation electrode of the surface mount antenna 20 and the surface mount antenna 30, shown in FIG. 3 an FIG. 4 respectively, may also comprise a reverse F antenna, achieving the same effects.

Figure 6:
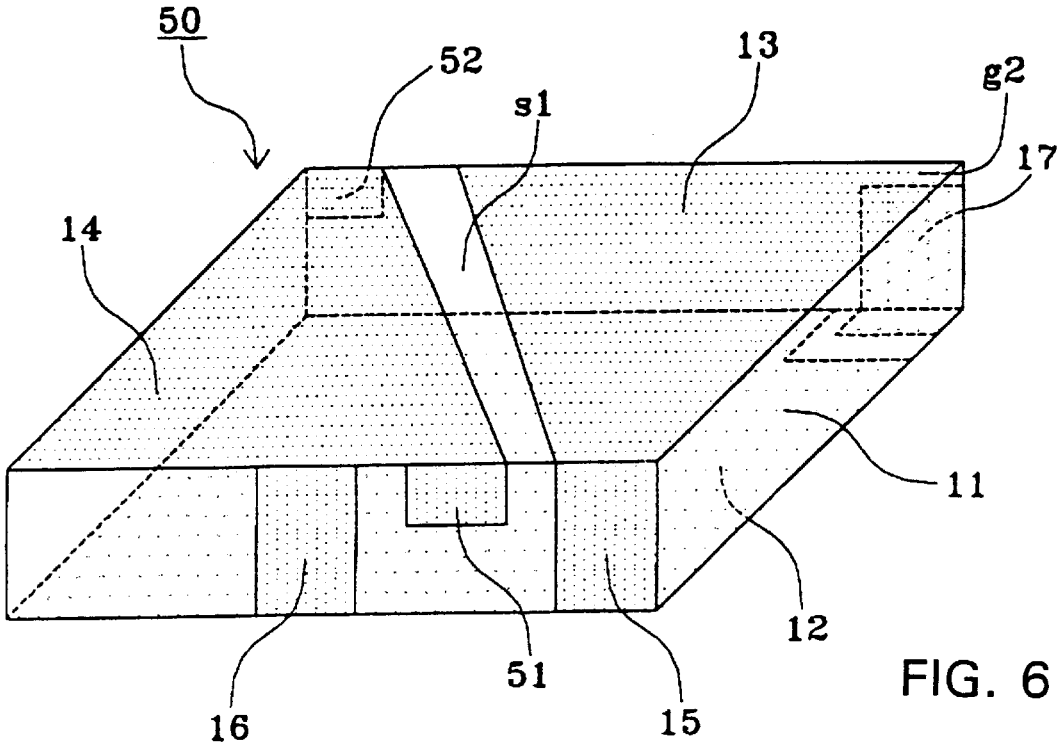
FIG. 6 is a see-through perspective view of yet another embodiment of a surface mount antenna of the present invention.

FIG. 6 shows yet another embodiment of the surface mount antenna of the present invention. In FIG. 6, like reference numerals are used for like members of FIG. 1, and explanation thereof will be omitted.

In the surface mount antenna 60 shown in FIG. 6, capacitance-loaded electrodes 51 and 52 are connected to end portions of the second radiation electrode 14 which are near to the ends of the slit s1, that is, the end portion at the end of the long side and the end portion at the end of the short side. Here, the capacitance-loaded electrodes 51 and 52 are provided on end faces of the base 11 and connect to the second radiation electrode 14, with a space being provided between the electrodes 51 and 52 and the ground electrode 12, and consequently capacitance is formed between the capacitance-loaded electrodes 51 and 52 and the ground electrode 12. Therefore, the capacitance between the second radiation electrode 14 and the ground electrode 12 increases at the end portions where the capacitance-loaded electrodes 51 and 52 are provided. This capacitance increases as the space between the capacitance-loaded electrodes 51 and 52 and the ground electrode 12 decreases.

Figure 7:
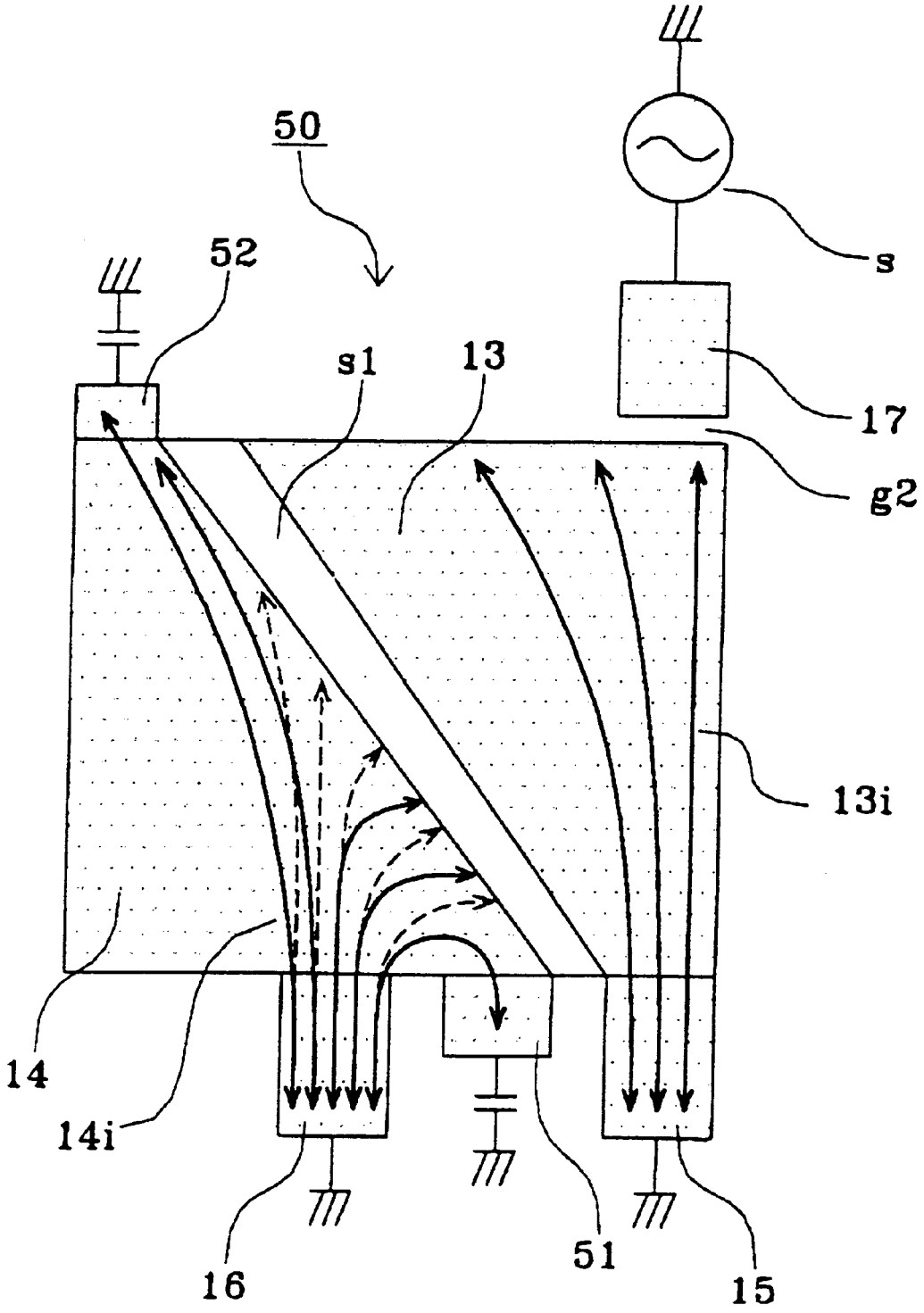
FIG. 7 is a plan view of the antenna of FIG. 6.

Here, FIG. 7 shows a plan view of a surface mount antenna 50 of such a constitution, and the operation of this surface mount antenna 50 will be explained using this diagram. In FIG. 7, the electrodes provided on the end faces of the base 11 are shown opened out in order to simplify understanding of the states of the first connection electrode 15, the second connection electrode 16, the feed electrode 17, and the capacitance-loaded electrodes 51 and 52.

In FIG. 7, several different values of resonant currents 13*i* and 14*i*, flowing through the first radiation electrode 13 and the second radiation electrode 14, are shown, rather than an average value.

Due to the provision of the capacitance-loaded electrodes 51 and 52 in the second radiation electrode 14 of the surface mount antenna 50, the resonant current 14*i* curves in the direction of the capacitance-loaded electrodes 51 and 52, that is, toward the ends of the slit s1. Consequently, current which should flow parallel to the resonant current 13*i* flowing through the first radiation electrode 13 when there is no capacitance-loaded electrode 52 (as shown by a broken line in FIG. 7) curves in the direction of the capacitance-loaded electrode 52. When resonant current flowing through the second radiation electrode 14 is parallel to the resonant current flowing through the first radiation electrode 13, there is interference between the resonant currents which makes it difficult to obtain double resonance, but by providing the capacitance-loaded electrode 52, this paralleling of currents can be reduced, thereby making it easier to achieve double resonance.

On the other hand, the capacitance-loaded electrode 51 has a greater effect of curving the resonant current 14*i* flowing through the second radiation electrode 14, and therefore it is possible to make the average direction of the resonant current 14*i*, flowing through the second radiation electrode 14, almost perpendicular to the resonant current 13*i*, flowing through the first radiation electrode 13.

The capacitance-loaded electrodes do not have to be provided on both end sides of the slit s1, but can be provided on either one of the sides as required.

The width of the slit s1 is different at each end, and this produces an effect similar to that of the capacitance-loaded electrode 52. Firstly, by making the width of the other end of the slit s1 greater than the width of the first end, the capacitance between the second radiation electrode 14 and the first radiation electrode 13 at the other end of the slit s1 is relatively reduced. As a consequence, not much of the resonant current 14*i* of the second radiation electrode 14 flows toward the other end side of the slit s1. The portion of the resonant current 14*i* which is flowing toward the other end side of the slit s1 is liable to become parallel to the resonant current 13*i* flowing through the first radiation electrode 13, and so by reducing this, the same effects can be obtained as when the capacitance-loaded electrode 52 was provided.

In the surface mount antenna 50, the capacitance-loaded electrodes 51 and 52 were provided to the second radiation electrode 14 of the surface mount antenna 10 shown in FIG. 1, but the same effects can be obtained by providing capacitance-loaded electrodes to the second radiation electrode of any of the surface mount antennas 20, 30 and 40 shown in FIG. 3 to FIG. 5.

In each of the above embodiments, the width of the slit, provided between the first and second radiation electrodes, was different at each end, but the same effects can be obtained when a slit of uniform width is provided.

Furthermore, in each of the above embodiments, the base 11 comprised a dielectric, but a magnetic body, which is also an insulator, may be used instead. In that case, the same effects can be obtained, with the exception of small-scaling by wavelength contraction.

Figure 8:
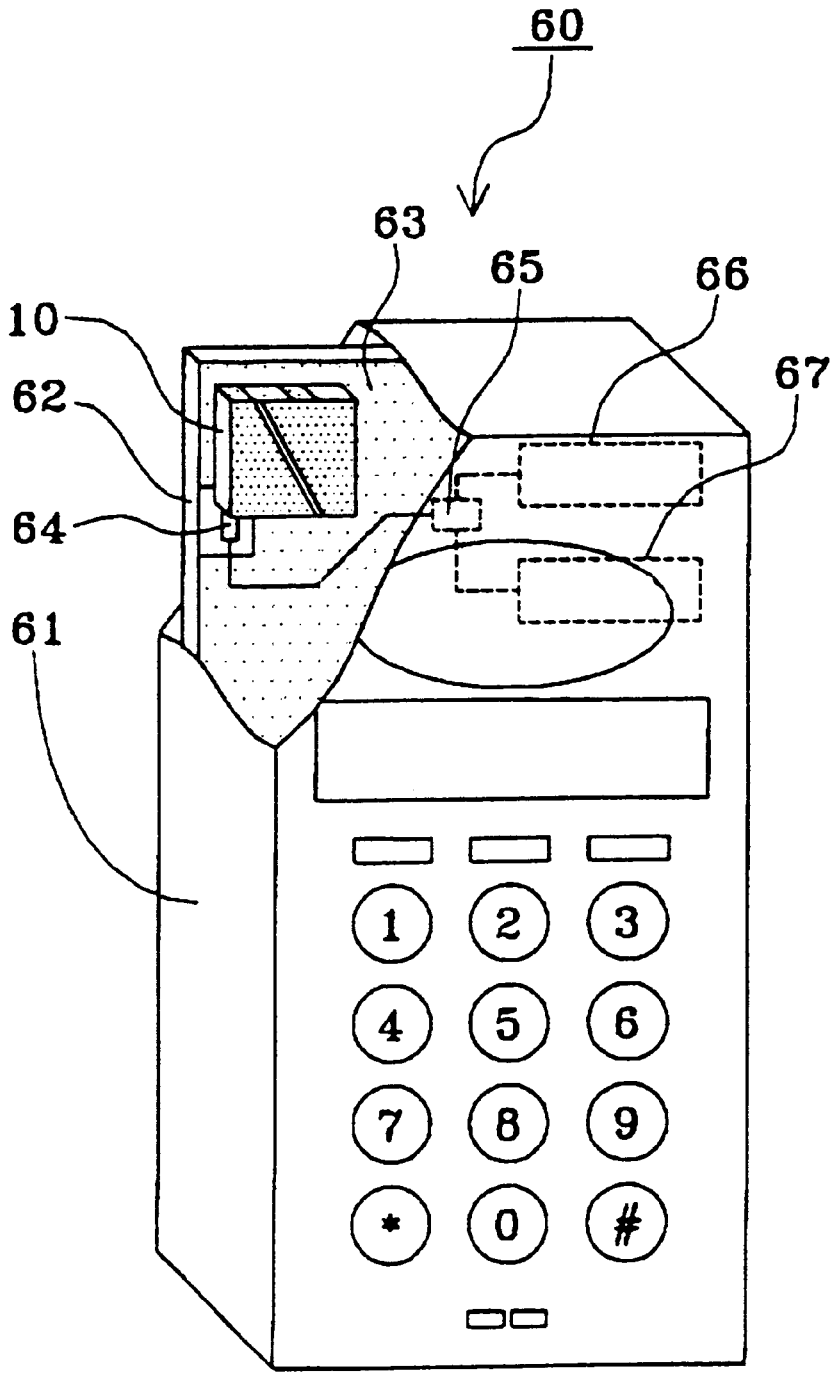
FIG. 8 is a partially cutaway perspective view of an embodiment of a communication apparatus of the present invention.
Figure 9:
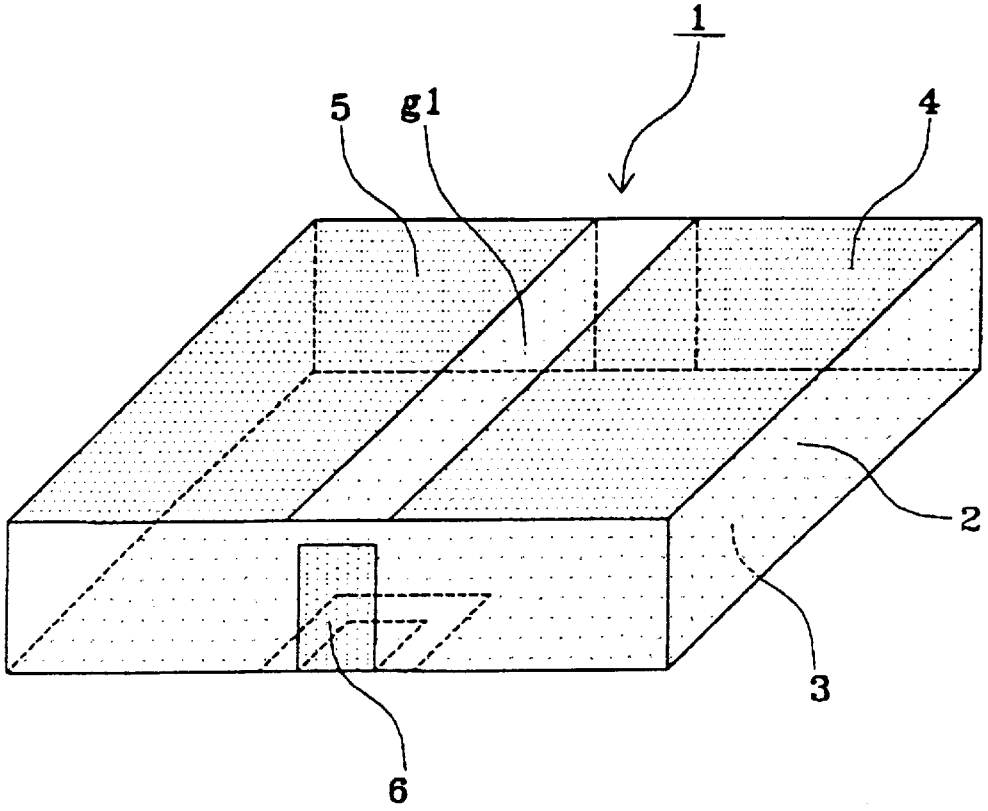
FIG. 9 PRIOR ART
FIG. 9 is a see-through perspective view of a conventional surface mount antenna.

FIG. 8 shows an embodiment of a communication apparatus of the present invention. In FIG. 8, a mounting substrate 62 is provided inside the case 61 of a communication apparatus 60, and a ground electrode 63 and a feed electrode 64 are provided on the mounting substrate 62. Then, the surface mount antenna 10, shown in FIG. 1, is mounted on the mounting substrate 62 as a main antenna by connecting the connection electrode of the antenna 10 to the connection electrode 63 of the mounting substrate 62, and connecting the feed electrode of the antenna 10 to the feed electrode 64 of the mounting substrate 62. Furthermore, the feed electrode 64 connects to a transmitter 66 and a receiver 67, which are similarly provided on the mounting substrate 62, via a switch 65 provided on the mounting substrate 62.

By this constitution, the communication apparatus 60 of the present invention does not require a whip antenna, and can be made small-scale with cost reduction.

The communication apparatus 60 used the surface mount antenna 10 shown in FIG. 1, but the same effects can be obtained with a constitution using the surface mount antenna antennas 20, 30, 40 and 50 shown in FIGS. 3, 4, 5 and 6.

While preferred embodiments of the present invention have been illustrated and described, it will be understood by a person skilled in the art that modifications may be made thereto within the range of the present invention.

What is claimed is:

1. A surface mount antenna, comprising:

a base, comprising an insulator having a first main face, a second main face and end faces extending between said first main face and second main face;

a ground electrode provided on the first main face of said base;

first and second radiation electrodes, provided on the second main face of said base; and a first connection electrode, a second connection electrode and a feed electrode, provided on end faces of said base;

said first and second radiation electrodes facing each other with a slit in between, said slit being provided at a diagonal to all sides of the second main face of said base, the slit having first and second ends extending to end portions of the second main face;

an end of said first radiation electrode which is near to the first end of said slit connecting to said ground electrode via said first connection electrode;

said feed electrode being provided near to an end portion of the first radiation electrode, with a gap provided between the feed electrode and the first radiation electrode, said end portion being distant from another end portion of said first radiation electrode where said first connection electrode is connected; and an end portion of said second radiation electrode, which is a fixed distance from the first end of said slit, connected to said ground electrode via said second connection electrode.

2. The surface mount antenna according to claim 1, wherein a capacitance-loaded electrode is connected to at least one end portion of said second radiation electrode which is near to at least one of the first and second ends of said slit.

3. A surface mount antenna, comprising:

a base, comprising an insulator having a first main face, a second main face and end faces extending between said first main face and second main face;

a ground electrode, provided on the first main face of said base;

first and second radiation electrodes, provided on the second main face of said base; and a first connection electrode, a second connection electrode and a feed electrode, provided on end faces of said base;

said first and second radiation electrodes facing each other with a slit in between, said slit being provided at a diagonal to all sides of the second main face of said base, the slit having first and second ends extending to end portions of the second main face;

an end of said first radiation electrode which is near to the first end of said slit connecting to said ground electrode via said first connection electrode;

said feed electrode being connected in the vicinity of an end portion of said first radiation electrode where said first connection electrode is connected; and an end portion of said second radiation electrode, which is a fixed distance from the first end of said slit, connected to said ground electrode via said second connection electrode.

4. The surface mount antenna according to claim 3, wherein a capacitance-loaded electrode is connected to at least one end portion of said second radiation electrode which is near to at least one of the first and second ends of said slit.

5. A communication apparatus comprising a surface mount antenna, said surface mount antenna comprising:

a base, comprising an insulator having a first main face, a second main face and end faces extending between said first main face and second main face;

a ground electrode, provided on the first main face of said base;

first and second radiation electrodes, provided on the second main face of said base; and a first connection electrode, a second connection electrode and a feed electrode, provided on end faces of said base;

said first and second radiation electrodes facing each other with a slit in between, said slit being provided at a diagonal to all sides of the second main face of said base, the slit having first and second ends extending to end portions of the second main face;

an end of said first radiation electrode which is near to the first end of said slit connecting to said ground electrode via said first connection electrode;

said feed electrode being provided near to an end portion of the first radiation electrode, with a gap provided between the feed electrode and the first radiation electrode, said end portion being distant from another end portion of said first radiation electrode where said first connection electrode is connected; and an end portion of said second radiation electrode, which is a fixed distance from the first end of said slit, connected to said ground electrode via said second connection electrode.

6. The communication apparatus according to claim 5, wherein a capacitance-loaded electrode is connected to at least one end portion of said second radiation electrode which is near to at least one of the first and second ends of said slit.

7. A communication apparatus comprising a surface mount antenna, said surface mount antenna comprising:

a base, comprising an insulator having a first main face, a second main face and end faces extending between said first main face and second main face;

a ground electrode, provided on the first main face of said base;

first and second radiation electrodes, provided on the second main face of said base; and a first connection electrode, a second connection electrode and a feed electrode, provided on end faces of said base;

said first and second radiation electrodes facing each other with a slit in between, said slit being provided at a diagonal to all sides of the second main face of said base, the slit having first and second ends extending to end portions of the second main face;

a end of said first radiation electrode which is near to the first end of said slit connecting to said ground electrode via said first connection electrode;

said feed electrode being connected in the vicinity of an end portion of said first radiation electrode where said first connection electrode is connected; and, an end portion of said second radiation electrode, which is a fixed distance from the first end of said slit, connected to said ground electrode via said second connection electrode.

8. The communication apparatus according to claim 7, wherein a capacitance-loaded electrode is connected to at least one end portion of said second radiation electrode which is near to at least one of the first and second ends of said slit.

* * * * *